United States Patent [19]

Stoudt

[11] Patent Number: 5,040,321

[45] Date of Patent: Aug. 20, 1991

[54] QUICK SET-UP SIGN STAND

[75] Inventor: Theodore L. Stoudt, Lake Oswego, Oreg.

[73] Assignee: Sign-Up Corporation, Portland, Oreg.

[21] Appl. No.: 543,538

[22] Filed: Jun. 26, 1990

Related U.S. Application Data

[63] Continuation-in-part of Ser. No. 510,891, Apr. 18, 1990, Continuation-in-part of Ser. No. 495,722, Mar. 19, 1990.

[51] Int. Cl.[5] ..... G09F 7/02

[52] U.S. Cl. ..... 40/611; 40/610; 40/612; 248/166

[58] Field of Search ..... 40/610, 612, 611; 248/188, 166, 165, 188.6

[56] References Cited

U.S. PATENT DOCUMENTS

| | | | |
|---|---|---|---|
| 1,135,241 | 4/1915 | Woods | 248/166 |
| 2,718,080 | 9/1955 | Eaton | 248/166 |
| 3,007,269 | 11/1961 | Jump | 248/166 |
| 3,165,847 | 1/1965 | Gunderson | 248/166 |

*Primary Examiner*—Kenneth J. Dorner
*Assistant Examiner*—Cassandra L. Hope
*Attorney, Agent, or Firm*—Grant L. Hubbard

[57] ABSTRACT

A quick set-up sign stand comprising first and second leg structures each having a non-circular circumferential locking central portion and ground-engaging portions, the leg structures pivotally mounted to face plates, the face plates secured in spaced apart relationship for receiving the sign and a leg-locking latch secured in moveable relationship to the plates for selectively locking the legs in a support position is disclosed.

18 Claims, 2 Drawing Sheets

QUICK SET-UP SIGN STAND

CROSS-REFERENCE TO RELATED PATENT APPLICATIONS

This is a continuation-in-part of pending U.S. patent applications Ser. Nos. 510,891, Apr. 18, 1990, and 495,722, Mar. 19, 1990, to which priority is claimed.

FIELD OF THE INVENTION

This invention relates to sign stands for display and warning purposes, such as those used at constructions sites along or near highways, constructions sites in or near building projects, or in buildings where repair is taking place, in parking lots and in parking structures, in merchandising, and generally where it is desired to provide a conspicuous display which can be put in place and removed or moved about without great difficulty.

BACKGROUND OF THE INVENTION

There are hundreds or thousands of signs and displays and many ingenious devices for supporting a sign in a particular location to accomplish a particular purpose. Not withstanding the enormous effort that has gone into this field, one of the problems which has plagued and continues to plague the sign and display industry is the problem of storage of signs when they're not in use and, in conjunction with the need for storage, to provide signs and sign stands which can be moved about easily and set up or dismantled for storage easily.

The problem of moving and storing signs presents a severe economic burden on some industries where the signs are taken down and erected frequently or moved about frequently. For example, in merchandising, it is often desirable to erect the sign in the front of the store or on the sidewalk in the morning and take it down in the evening, or to move it about, depending upon where the point of principal interest is. In construction, it is often necessary to place signs at particular locations to mark a hazard, for example, and to move these signs about frequently and to store them on occasion, as hazards are created and removed. In highway construction, it has become a major cost in the overall construction to provide signs and markers which will warn motorists of construction or a particular hazard or circumstance ahead in the highway. All of these problems cry out for a sign and a sign stand which are easily portable, easily stored in a minimum of space, and are easily erected and folded up for storage or for movement.

The traditional older prior art indicates a common usage of solid base sign stands, such as heavy circular bases, or heavy rectangular frames. These, of course, present serious difficulties in moving.

In spite of the many efforts to solve the economic and practical problems which are so extremely evident to those in the art and to those who rely upon portable signs for warning the public or otherwise, fully satisfactory solutions have yet to be provided.

One of the features of this invention is in the provision of a sign stand and a sign which is easily dismantled for storage and for movement, which occupies a minimum of space in storage and is easily and quickly erected for display.

SUMMARY OF THE INVENTION

The present invention is a quick set-up stand for supporting a sign which has formed therein an opening. A supporting base is provided which comprises first and second leg structures, each having a central portion and ground-engaging portions. The central portion is so constructed and configured as to form a non-circular-circumferential locking portion. The non-circular-circumferential portion of the leg is preferably constructed and configured in a generally cylindrical configuration having one flat side; i.e. a tubular section having one side flattened. The stand comprises first and second face plates and means securing the face plates in spaced apart relationship, spacing being provided by a spacer plate, for receiving therebetween the sign to be supported. Means are provided for mounting the leg structures relative to the respective face plates in pivotally movable relationship therewith. Leg-locking means are secured in moveable relationship to the plates for selectively locking the legs in a support position or for permitting the legs to pivot to a folded position. The leg-locking means preferably comprises a latch moveable to a first position in engagement with the non-circular-circumferential portion of the respective legs for preventing pivotal movement thereof and locking the legs for supporting the sign and to a second position to permit the respective legs to be folded adjacent the respective plates.

The leg-locking means may comprise a U-shaped leg-locking latch mounted and constructed to move relative to the legs between a first position in engaging relationship with the non-circular-circumferential portions on the first and second legs for locking the first and second legs, respectively, in the support position extending outwardly from the respective face plates and a second position out of engagement with the flats on the legs to permit the legs to pivot to a folded position approximately parallel with the respective plates. The U-shaped leg-locking latch comprises first and second arms and a central portion connecting the first and second arms and extending approximately perpendicular thereto, and the leg-locking means may include at least one guide pin extending through the plates and outwardly from the respective face plates. The first and second arms of the leg-locking latch are constructed and configured to define openings therein, said openings in the respective arms being so constructed and arranged as to receive the respective ends of the pin for guiding the sliding movement of the leg-locking latch. An operator extension may be formed as part of or secured to at least one of the arms of the leg-locking latch to permit the user to grasp the extension for moving the leg-locking latch.

The face plates may be so configured and constructed as to form therein a notch, the notches being in alignment with one another and disposed between the non-circular circumferential portions of the legs. The face plates may also be configured and constructed to define an opening therethrough, the openings in the sign and the face plates being in alignment when the sign is inserted between the face plates. In this embodiment, sign locking means are provided which comprise a handle having a grasping portion and at least one sign-locking extension. The handle is mounted for movement relative to one of the face plates, the sign-locking extension being mounted so as to be disposed adjacent the openings in the face plates and sign for selective movement into the respective openings for locking the sign between the plates or out of the respective openings for permitting the sign to be removed from between the face plates.

DESCRIPTION OF THE PREFERRED EMBODIMENT

The preferred embodiment of the invention is exemplary only and is described in its exemplary form. It is to be clearly understood that many variations and modifications of the various elements and constructions may be made without departing from the spirit of the invention or its scope as defined herein.

Figure 1:
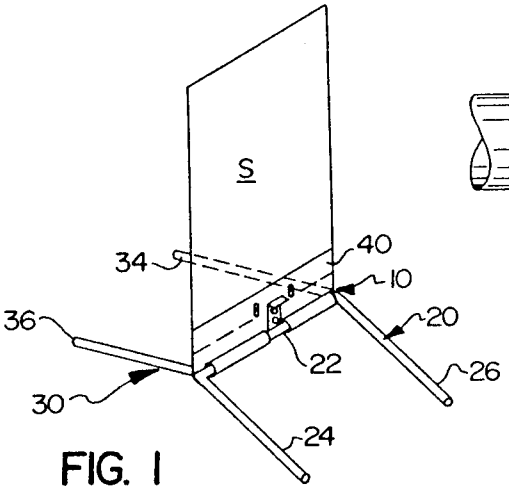
FIG. 1 is a perspective depiction of a first side of a sign and the sign stand of this invention.
Figure 2:
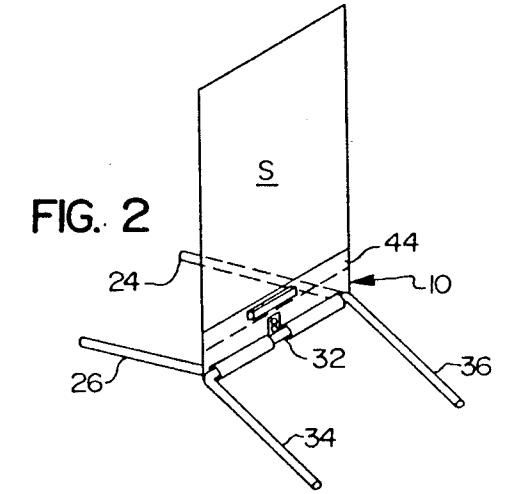
FIG. 2 is a perspective depiction of a second side of the sign and the sign stand of this invention.
Figure 5:
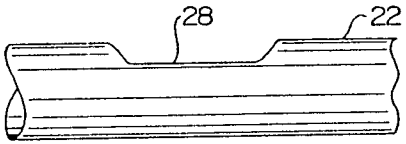
FIG. 5 is a side view of part of the central portion of one of the legs showing the non-circular-circumferential structure for locking the legs in the support position, the structure being depicted being generally a right cylinder having one flattened side.
Figure 3:
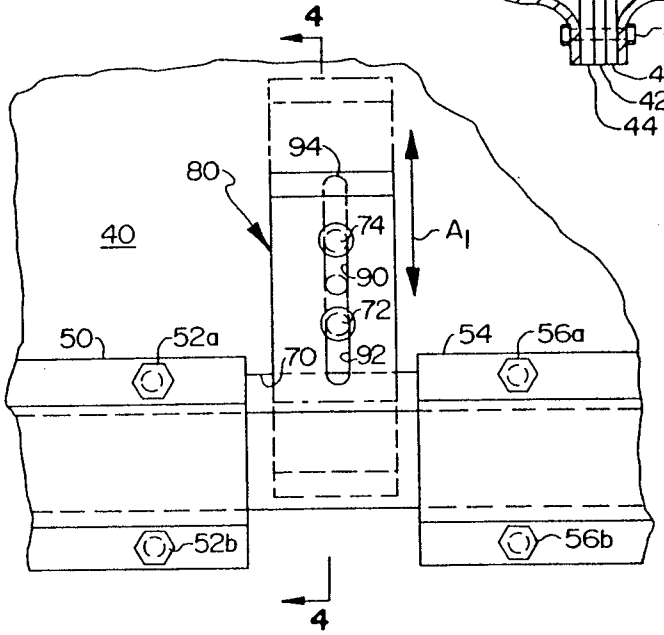
FIG. 3 is a greatly enlarged view of a portion of the first side of the sign stand showing in greater detail in plan view one side of the leg-locking latch mechanism of the invention.
Figure 4:
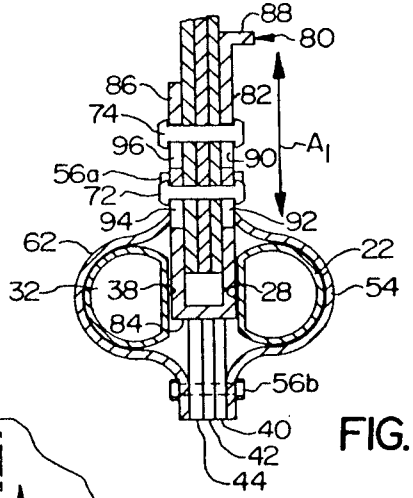
FIG. 4 is a cross-section view of the leg-locking latch mechanism of the invention taken substantially along lines 4—4 of FIG. 3.
Figure 8:
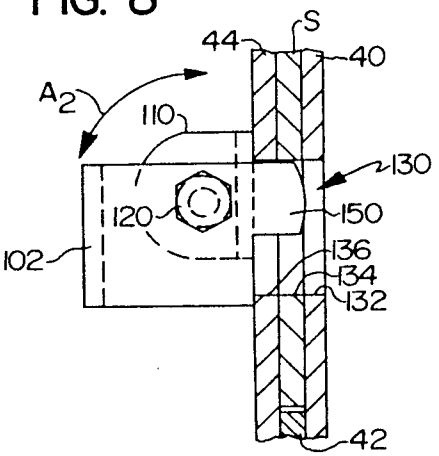
FIG. 8 is a cross-sectional view taken substantially along lines 7—7 of FIG. 6 showing one end of the sign-locking mechanism, in the sign-releasing position.
Figure 7:
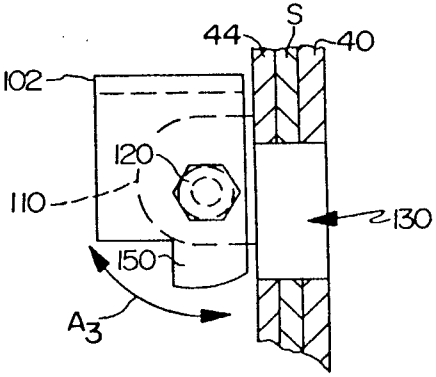
FIG. 7 is a cross sectional view taken substantially along lines 7—7 of FIG. 6 showing one end of the sign-locking mechanism, in the sign-locking position.
Figure 6:
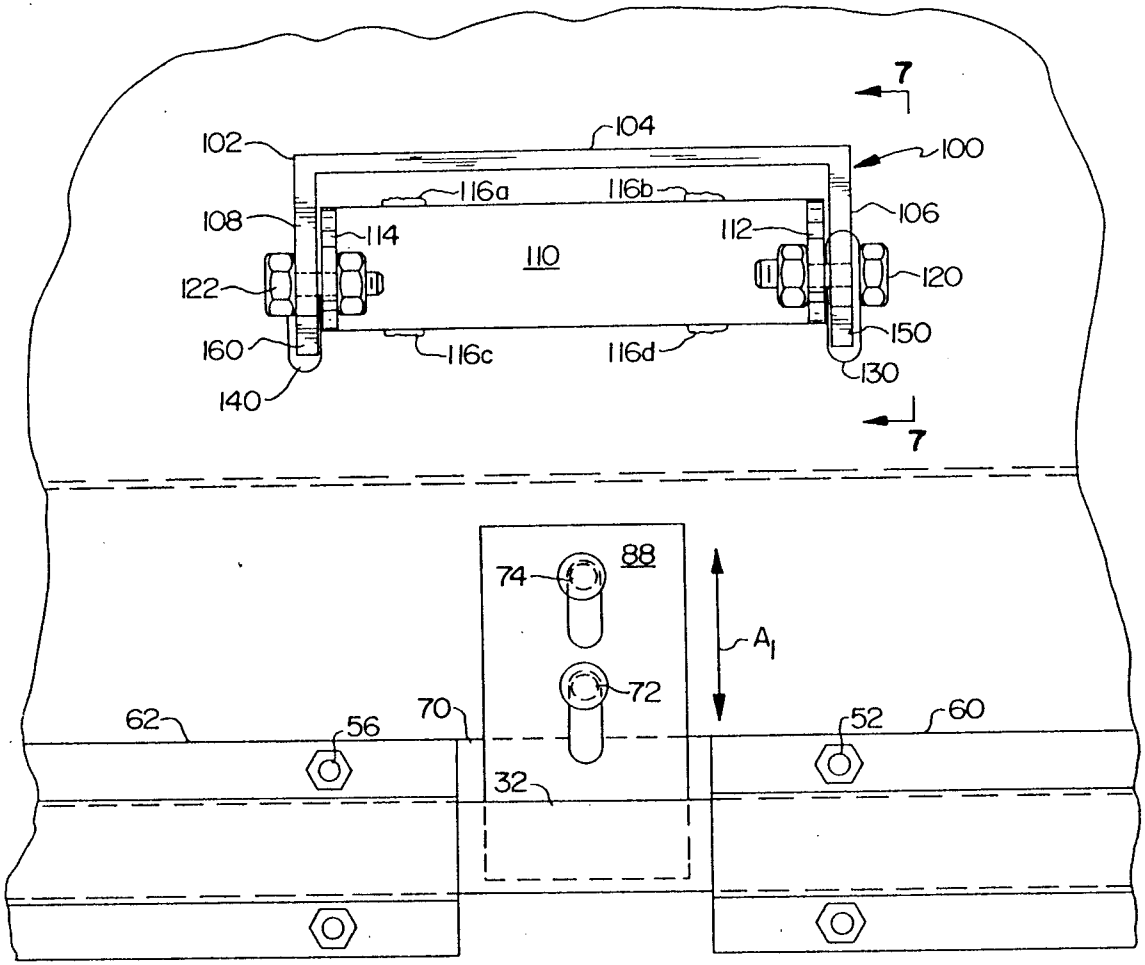
FIG. 6 is a greatly enlarged view of a portion of the first side of the sign stand showing in greater detail in plan view the other side of the leg-locking latch mechanism of the invention and the sign-locking mechanism of the invention.

According to this invention, a quick set-up stand, as generally depicted in FIGS. 1 and 2, is provided for supporting a sign. The sign stand comprises a supporting base 10 which, in turn, comprises the combination of the following structural elements or their mechanical equivalent, so arranged and configured as to perform the indicated functions.

A first U-shaped leg structure 20, generally formed of a bent tube is provided. The leg is preferably in the configuration of an elongate, linear, tubular central portion 22 and ground-engaging portions 24 and 26, respectively, extending approximately perpendicular from the respective ends of the central portion 22, the central portion 22 having formed therein a non-circular-circumferential portion such as flat 28.

A second U-shaped leg structure 30, generally similar to the first leg structure, is also provided. The second leg structure in configured to have an elongate, tubular, linear central portion 32 and ground-engaging portions 34 and 36, respectively, extending approximately perpendicular from the respective ends of the central portion 32, the central portion 32 having formed therein a non-circular-circumferential portion such as flat 38. Thus, a first generally planar face plate 40, a second generally planar face plate 44, and a generally planar spacer plate 42 are provided along clamping means for securing the plates to the leg assemblies. A first clamping assembly is provided comprising opposed elongate, linear, partially cylindrical brackets 54, 62 and fastener means 56, securing the brackets 54, 62 against the respective face plates 40, 44, said brackets forming a partially generally cylindrical recess, configured and dimensioned to receive a first part of the central portion 22, 32 of the respective leg structures 20, 30 therein for pivotal rotation therein. In like manner, but generally in mirror-image configuration and orientation, a second clamping assembly is provided comprising opposed elongate, linear partially cylindrical brackets 50, 60 and fastener means 52 securing the brackets 50, 60 against the respective face plates 40, 44, said brackets forming a partially generally cylindrical recess configured and dimensioned to receive a second part of the central portion 22, 32 of the respective leg structures 20, 30 therein for rotation therein.

In a convenient, and currently preferred embodiment, the face plates and spacer plate 40, 42, 44 having formed therein a notch, the flats 28, 38 of the legs 20, 30 and the notch being in alignment with one another, the notch being disposed between the flats. Means are provided for locking the first and second legs in a support position and, respectively, in a storage position. The preferred leg-locking structure comprises a pair of guide pins 72, 74 extending through the plates 40, 42, 44 and a U-shaped leg-locking latch 80 having a first arm 82 disposed in slidable relation to the first face plate 40, a second arm 86 disposed in slidable relation to the second face plate 44, a central portion 84. The central portion extends through the notch 70 in the plates 40, 42, 44 and an operator extension 88 is secured to one of the arms 82, 86 of the latch 80. The first arm 82 defines therethrough a first slot 90 and a second slot 92, and the second arm 86 defining therethrough a third slot 94 and a fourth slot 96. The first and fourth slots 90, 96 are in alignment with each other and receive one of the guide pins 74 and the second and third slots 92, 94 being in alignment with each other and receive the other guide pin 72.

The leg-locking latch is movable relative to the plates between a first position in engaging relationship with the non-circular-circumferential portions, e.g. the flats, on the legs for locking the first and second leg assemblies, respectively, in the support position extending outwardly from the respective face plates and a second position out of engagement with the flats on the legs to permit the legs to fold to a closed position substantially parallel with the plane of the plates.

A sign S which has formed in it an opening or passage, as will be described, is, in use, received between the face plates 40, 44 in a space defined therebetween by the spacer plate 42.

Means 100 are provided for locking a sign S between the face plates. The plate-locking means preferably comprises a U-shaped handle 102 having a central grasping portion 104 and, at respective ends of the grasping portions, arm portions 106, 108. A generally U-shaped mounting bracket 110 having a central portion and mounting extensions 112, 114 extending from the central portion is mounted to one of the face plates by a weldment 116, or any other fastener means. Pivotal mounting means 120, 122 pivotally mount the handle 102 to the bracket 110.

The sign S and the face plates 40, 44 having formed therein aligned apertures 132, 134, 136 defining a first passage 130 through the sign and another generally similar aperture spaced from apertures 132, 134, 136 defining a second passage 140 through the sign and the plates, the second aperture being shown only generally.

Sign-locking extensions 150, 160 extend from the handle 102 and are disposed adjacent the passages 130, 140 for being moved into the respective passages for locking the sign between the plates or for being moved out of the respective passages for permitting the sign to be removed from between the face plates by pivotally moving the handle from a locking position to an unlocking position.

The various elements of the base may be formed of sheet metal by conventional bending, punching, forming and machining methods. Generally speaking, it is most economical to use steel components, but for lighter weight, aluminum may be used. Titanium may also be used, but it is quite expensive and difficult to handle. The materials may also be selected from various plastics, or more properly polymers, and formed by well-known plastic forming methods, such as vacuum forming, injection molding, etc. Obviously, a combination of metal and plastic elements may be used. Generally speaking, again, where long life and ruggedness are important, steel plates and tubing are most preferred, but the nature of the material of which the sign stand is formed is not particularly critical. Likewise, the sign itself may be formed of any desired material. Greater strength and ruggedness is provided by the use of steel sheets, but aluminum sheets are quite satisfactory in many applications, and sheets of rigid or semi-rigid polymer may also be used. The sign itself may be formed of a flexible polymer with a frame, with a bar or other structure which has an opening formed in it as described above. In other words, the material and construction of the sign is of no importance whatever, except to the extent that it will be received in and locked in the sign stand as described.

In a preferred embodiment, the legs are steel tubing bent to form a U-shaped configuration, as described and depicted in the drawings, and in the central portion to define a non-circular-circumferential portion, such as a flat. It is convenient to form a flat, and the flat provides a very convenient locking mechanism, but other non-circular configurations may be used. For example, a depression may be formed in the tubing in which the locking device will engage.

With respect to the leg-locking mechanism, it is presently preferred to provide pins for guiding the locking latch in its movement, but other guide means would be equivalent, since the nature of the guide means is not critical. Indeed, no guide means at all needs to be provided, but guiding is preferred for smooth operation. Guide means such as protuberances or attachments on the sides of the latch may, for example, be provided.

One of the significant advantages of the sign-locking mechanism is that it is in the form of a handle which is rugged, easily grasped, difficult to deform and also provides a handle for carrying the base when moving the sign stand about. It is also convenient to provide double locking of the sign, as described, but single locking is also satisfactory.

When preparing the sign stand for use, assuming the user is removing the sign stand from a storage container or from storage or a vehicle for use, all that is necessary is to place the sign stand on the ground, allow the legs to unfold and lay on the ground, grasp the handle or the sign stand generally, and lift it. When the sign stand itself is lifted, the legs will pivot to their support position at which time the locking latch will slide into the space provided by the flat on the central portion of the legs and lock the legs in the support position. All this can be done with one hand. With the sign stand being supported on the ground or other surface which would be equivalent, the user simply lifts the sign and drops it down into the slot between the two face plates. The handle is moved up by the action of the sign on the arcuate portion of the sign locking extensions and then falls back with the extensions in the openings or passages through the sign, locking the sign into the sign stand. Thereafter, the sign and the sign stand can be moved about, turned for orientation, etc., simply by lifting the sign.

Dismantling the sign is equally simple. The user simply lifts the locking handle, removes the sign, and lifts the leg-locking latch and folds the legs so that the legs lie substantially parallel to the face plates.

Among the economies accomplished by the present invention is the economy in storage. Several hundred of the present sign stands can be stored in the same space now required for a dozen or so of the more traditional sign stands.

Another economy, which is quite apparent from the preceding description of the manner of use, is in the very small amount of time and effort required to set up or dismantle the sign stand. Labor, being a very important economic factor in all operations, is saved, and great cost savings overall are accomplished.

INDUSTRIAL APPLICATION

This invention finds application in the sign stand, parking, construction, and merchandising industries.

What is claimed is:

1. A quick set-up stand for supporting a sign which has formed therein an opening, comprising: a supporting base which comprises first and second leg structure each having a central portion and ground-engaging portions, the central portion being so constructed and configured as to form a non-circular-circumferential locking portion therein, first and second face plates, means securing the face plates in spaced apart relationship for receiving therebetween the sign to be supported, means mounting the leg structures to the respective face plates in pivotally movable relationship therewith, and leg-locking means secured in moveable relationship to the plates for selectively locking the legs in a support position or for permitting the legs to pivot to a folded position, said leg-locking means comprising a latch moveable to a first position in engagement with the non-circular-circumferential portion of the respective legs for preventing pivotal movement thereof and locking the legs for supporting the sign and to a second position to permit the respective legs to be folded adjacent the respective plates.

2. The quick set-up sign stand of claim 1 wherein the leg-locking means comprises: a U-shaped leg-locking latch mounted and constructed to move relative to the legs between a first position in engaging relationship with the non-circular-circumferential portions on the first and second legs for locking the first and second legs, respectively, in the support position extending outwardly from the respective face plates and a second position out of engagement with the non-circular-circumferential portions of the legs to permit the legs to pivot to a folded position approximately parallel with the respective plates.

3. The quick set-up sign stand of claim 2 wherein the U-shaped leg-locking latch comprises first and second arms and a central portion connecting the first and second arms and extending approximately perpendicular thereto, and the leg-locking means further comprises: at least one guide pin having first and second ends extending through the plates and outwardly from the respective face plates, and wherein the first and second arms of the leg-locking latch are constructed and configured to define openings therein, said openings in the respective arms being so constructed and arranged as to receive the respective ends of the pin for guiding sliding movement of the leg locking latch.

4. The quick set-up sign stand of claim 3 wherein the leg-locking means further comprises: an operator extension secured to at least one of the arms of the leg-locking latch to permit the user to grasp the extension for moving the leg-locking latch.

5. The quick set-up sign stand of claim 4 wherein each of the face plates are so configured and constructed as to formed therein a notch, the notches being in alignment with one another and disposed between the non-circular circumferential portions of the legs.

6. The quick set-up sign stand of claim 5 wherein the non-circular-circumferential portion of the leg is constructed and configured in a generally cylindrical configuration having one flat side.

7. The quick set-up sign stand of claim 6 wherein the face plates are configured and constructed to define an opening therethrough, the openings in the sign and the face plates being in alignment when the sign is inserted between the face plates, and further comprising: sign-locking means which comprises a handle having a grasping portion and at least one sign-locking extension, means mounting the handle for movement relative to one of the face plates, said sign-locking extension being mounted so as to be disposed adjacent the openings in the face plates and sign for selective movement into the respective openings for locking the sign between the plates or out of the respective openings for permitting the sign to be removed from between the face plates.

8. The quick set-up sign stand of claim 5 wherein the face plates are configured and constructed to define an opening therethrough, the openings in the sign and the face plates being in alignment when the sign is inserted between the face plates, and further comprising: sign-locking means which comprises a handle having a grasping portion and at least one sign-locking extension, means mounting the handle for movement relative to one of the face plates, said sign-locking extension being mounted so as to be disposed adjacent the openings in the face plates and sign for selective movement into the respective openings for locking the sign between the plates or out of the respective openings for permitting the sign to be removed from between the face plates.

9. The quick set-up sign stand of claim 8 wherein the sign-locking means comprises: a generally U-shaped handle having a central portion and mounting extensions extending from the central portion, at least one sign locking extensions on at least one of the mounting extensions, means mounting the handle for pivotal movement relative to a face plate, the face plates having formed therein aligned apertures defining at least one passage through the plates in alignment with the opening in the sign, the sign-locking extension being disposed adjacent the said passage for being moved into the passages for locking the sign between the plates and being moved out of the passages for permitting the sign to be removed from between the face plates by pivotally moving the handle from a locking position to an unlocking position.

10. The quick set-up sign stand of claim 1 wherein the face plates are configured and constructed to define an opening therethrough, the openings in the sign and the face plates being in alignment when the sign is inserted between the face plates, and further comprising: sign-locking means which comprises a handle having a grasping portion and at least one sign-locking extension, means mounting the handle for movement relative to one of the face plates, said sign-locking extension being mounted so as to be disposed adjacent the openings in the face plates and sign for selective movement into the respective openings for locking the sign between the plates or out of the respective openings for permitting the sign to be removed from between the face plates.

11. The quick set-up sign stand of claim 10 wherein the sign-locking means comprises: a generally U-shaped handle having a central portion and mounting extensions extending from the central portion, at least one sign-locking extensions on at least one of the mounting extensions, means mounting the handle for pivotal movement relative to a face plate, the face plates having formed therein aligned apertures defining at least one passage through the plates in alignment with the opening in the sign, the sign-locking extension being disposed adjacent the said passage for being moved into the passages for locking the sign between the plates and being moved out of the passages for permitting the sign to be removed from between the face plates by pivotally moving the handle from a locking position to an unlocking position.

12. The quick set-up sign stand of claim 10 wherein the non-circular-circumferential portion of the leg is constructed and configured in a generally cylindrical configuration having one flat side.

13. The quick set-up sign stand of claim 10 wherein the leg-locking means comprises: a U-shaped leg-locking latch mounted and constructed to move relative to the legs between a first position in engaging relationship with the non-circular-circumferential portions on the first and second legs for locking the first and second legs, respectively, in the support position extending outwardly from the respective face plates and a second position out of engagement with the non-circular-circumferential portions of the legs to permit the legs to pivot to a folded position approximately parallel with the respective plates.

14. The quick set-up sign stand of claim 13 wherein the U-shaped leg-locking latch comprises first and second arms and a central portion connecting the first and second arms and extending approximately perpendicular thereto, and the leg-locking means further comprises: at least one guide pin extending through the plates and outwardly from the respective face plates, and wherein the first and second arms of the leg-locking latch are constructed and configured to define openings therein, said openings in the respective arms being so constructed and arranged as to receive the respective ends of the pin for guiding the sliding movement of the leg-locking latch.

15. The quick set-up sign stand of claim 14 wherein the leg-locking means further comprises: an operator extension secured to at least one of the arms of the leg-locking latch to permit the user to grasp the extension for moving the leg-locking latch.

16. The quick set-up sign stand of claim 15 wherein each of the face plates are so configured and constructed as to formed therein a notch, the notches being in alignment with one another and disposed between the non-circular circumferential portions of the legs.

17. The quick set-up sign stand of claim 16 wherein the non-circular-circumferential portion of the leg is constructed and configured in a generally cylindrical configuration having one flat side.

18. The quick set-up sign stand of claim 17 wherein the sign-locking means comprises: a generally U-shaped handle having a central portion and mounting extensions extending from the central portion, at least one sign-locking extension on at least one of the mounting extensions, means mounting the handle for pivotal movement relative to a face plate, the face plates having formed therein aligned apertures defining at least one passage through the plates in alignment with the opening in the sign, the sign-locking extension being disposed adjacent the said passage for being moved into the passages for locking the sign between the plates and being moved out of the passages for permitting the sign to be removed from between the face plates by pivotally moving the handle from a locking position to an unlocking position.

* * * * *